US009994410B2

(12) United States Patent
Egawa et al.

(10) Patent No.: US 9,994,410 B2
(45) Date of Patent: Jun. 12, 2018

(54) SHEET LOADING DEVICE, AND SHEET POST-PROCESSOR AND IMAGE FORMING APPARATUS PROVIDED WITH THE SAME

(71) Applicant: KYOCERA Document Solutions Inc., Osaka (JP)

(72) Inventors: Keisuke Egawa, Osaka (JP); Yasunori Ueno, Osaka (JP)

(73) Assignee: KYOCERA Document Solutions Inc., Osaka (JP)

( * ) Notice: Subject to any disclaimer, the term of this patent is extended or adjusted under 35 U.S.C. 154(b) by 0 days. days.

(21) Appl. No.: 15/490,488

(22) Filed: Apr. 18, 2017

(65) Prior Publication Data

US 2017/0305703 A1 Oct. 26, 2017

(30) Foreign Application Priority Data

Apr. 26, 2016 (JP) ..... 2016-087821

(51) Int. Cl.

| | |
|---|---|
| ***B65H 31/04*** | (2006.01) |
| ***B65H 31/10*** | (2006.01) |
| ***B65H 7/02*** | (2006.01) |
| ***B65H 7/20*** | (2006.01) |

(Continued)

(52) U.S. Cl.

CPC ..... *B65H 31/10* (2013.01); *B65H 7/02* (2013.01); *B65H 7/20* (2013.01); *B65H 31/26* (2013.01); *G03G 15/6529* (2013.01); *G03G 15/6552* (2013.01); *B65H 2405/353* (2013.01);

(Continued)

(58) Field of Classification Search

CPC ... B65H 7/00; B65H 7/02; B65H 7/14; B65H 7/20; B65H 31/00; B65H 31/04; B65H 31/10; B65H 31/26; B65H 31/30; B65H 31/3054; B65H 2405/32; B65H 2405/324;

(Continued)

(56) References Cited

U.S. PATENT DOCUMENTS

2009/0283961 A1* 11/2009 Saito ..... B65H 31/10 271/220
2010/0133745 A1* 6/2010 Ikeuchi ..... B65H 1/14 271/265.04

(Continued)

FOREIGN PATENT DOCUMENTS

JP H 11-322187 A 11/1999
JP 2007-15824 A 1/2007

*Primary Examiner* — Prasad V Gokhale
(74) *Attorney, Agent, or Firm* — Stein IP, LLC

(57) ABSTRACT

A sheet loading device is provided with a sheet ejection portion, a sheet loading portion, a first detection mechanism, a driving device, a second detection mechanism, and a control portion. The driving device drives the sheet loading portion to ascend/descend between an upper surface detection position and a reference position made to descend by a prescribed distance from the upper surface detection position. The second detection mechanism detects that the sheet loading portion is at the reference position. In a case where sheets of the same type are ejected continuously from the sheet ejection portion, the control portion controls beforehand the sheet loading portion to ascend from the reference position to the upper surface detection position and sets a loadable number of sheets of the sheet loading portion in accordance with an ascending time of the sheet loading portion.

7 Claims, 5 Drawing Sheets

(51) Int. Cl.
*B65H 31/26* (2006.01)
*G03G 15/00* (2006.01)

(52) U.S. Cl.
CPC .... *B65H 2511/152* (2013.01); *B65H 2801/06* (2013.01); *G03G 2215/00911* (2013.01)

(58) Field of Classification Search
CPC ..... B65H 2405/35; B65H 2405/353; B65H 2511/15; B65H 2511/152
See application file for complete search history.

(56) References Cited

U.S. PATENT DOCUMENTS

2011/0095470 A1* 4/2011 Bridges ..... B26F 1/02 270/58.07
2013/0193637 A1* 8/2013 Taguchi ..... G03G 15/6544 271/207

* cited by examiner

SHEET LOADING DEVICE, AND SHEET POST-PROCESSOR AND IMAGE FORMING APPARATUS PROVIDED WITH THE SAME

INCORPORATION BY REFERENCE

This application is based upon and claims the benefit of priority from the corresponding Japanese Patent Application No. 2016-087821 filed on Apr. 26, 2016, the entire contents of which are incorporated herein by reference.

BACKGROUND

The present disclosure relates to a sheet loading device that is used in an image forming apparatus such as a copy machine, a facsimile, or a printer and a sheet post-processor that performs post-processing such as a punch hole forming process or a binding process with respect to a sheet such as a paper sheet on which an image has been formed by the image forming apparatus, the sheet post-processor and the image forming apparatus provided with the same.

In an electrophotographic image forming apparatus, a circumferential surface of an image carrier (a photosensitive drum) is irradiated with light based on image information read from an original document image or image information obtained by, for example, transmission from an external device such as a computer, and thus an electrostatic latent image is formed thereon. The electrostatic latent image is supplied with toner from a developing device so that a toner image is formed, which then is transferred on a paper sheet. The paper sheet that has gone through the transfer processing is subjected to fixing processing of the toner image and then is ejected from a sheet ejection portion onto an ejection tray.

In such an image forming apparatus, in order to detect a full load state of paper sheets ejected on the ejection tray, there is known a method in which notice is given of such a full load state at a point in time when the number of sheets ejected has reached a preset loadable number of sheets. Here, in a case where large-size paper sheets are to be ejected, since they are heavier in weight than small-size paper sheets, with durability of the ejection tray taken into consideration, the loadable number of sheets is decreased. It is, therefore, necessary that the loadable number of sheets be set to vary depending on whether small-size paper sheets or large-size paper sheets are used. In a case, however, where a load height is increased as a result of, for example, continuously printing high printing rate images, the ejection tray may be brought to a full load state before the loadable number of sheets is reached, which has been disadvantageous.

As another method for detecting a full load state of paper sheets, there is known a method in which a load detection sensor that detects a load height of paper sheets ejected on an ejection tray is provided, and based on a result of detection by the load detection sensor, a full load state of paper sheets on the ejection tray is detected. As such a load detection sensor, there is widely known a transmission type optical sensor that has a light receiving portion and a light emitting portion in a paper sheet width direction. A large-size paper sheet, however, hardly slides down along a slope of an ejection tray, and thus compared with a small-size paper sheet, an upper surface position thereof tends to vary. Furthermore, in a case of using the transmission type optical sensor, paper sheets can be detected only when loaded to a preset load height. It, therefore, becomes necessary that a load detection sensor for a small-size paper sheet and a load detection sensor for a large-size paper sheet be provided separately, resulting in a cost increase, which has been problematic.

As a solution to the above, there is known a sheet processor in which a distance measuring sensor that detects an uppermost surface of sheets is provided, and in a case where it has been detected a plurality of times continuously that a height of an uppermost surface of loaded sheets is not less than a prescribed height, it is judged that the sheets are in a full load state.

There is also known a sheet processor in which, when a weight of sheets loaded on a sheet loading unit has reached a prescribed weight, it is judged that the sheets are in a full load state, and thus sheet loading is stopped. Specifically, an ascending/descending time of a stack tray (the sheet loading unit) when fully loaded with sheets is stored beforehand, and in a case where an actual ascending time is slower than the ascending time of the stack tray when fully loaded with sheets or an actual descending time is faster than the descending time of the stack tray when fully loaded with sheets, it is judged that sheets loaded on the stack tray are in a full or higher load state.

SUMMARY

A sheet loading device according to one aspect of the present disclosure is provided with a sheet ejection portion, a sheet loading portion, a first detection mechanism, a driving device, a second detection mechanism, and a control portion. The sheet ejection portion ejects a sheet. The sheet loading portion is capable of ascending/descending, and a sheet ejected from the sheet ejection portion is loaded thereon. The first detection mechanism detects an upper surface of the sheet loading portion or of a sheet loaded on the sheet loading portion. The driving device drives the sheet loading portion to ascend/descend between an upper surface detection position at which the upper surface of the sheet loading portion or of a sheet loaded on the sheet loading portion is detected by the first detection mechanism and a reference position made to descend by a prescribed distance from the upper surface detection position. The second detection mechanism detects that the sheet loading portion is at the reference position. The control portion controls sheet ejection from the sheet ejection portion and ascending/descending of the sheet loading portion by the driving device. In a case where sheets of the same type are ejected continuously from the sheet ejection portion, the control portion controls beforehand the sheet loading portion to ascend from the reference position to the upper surface detection position and sets a loadable number of sheets of the sheet loading portion in accordance with an ascending time of the sheet loading portion.

Still other objects of the present disclosure and specific advantages provided by the present disclosure will be made further apparent from the following description of an embodiment.

DETAILED DESCRIPTION

Figure 1:
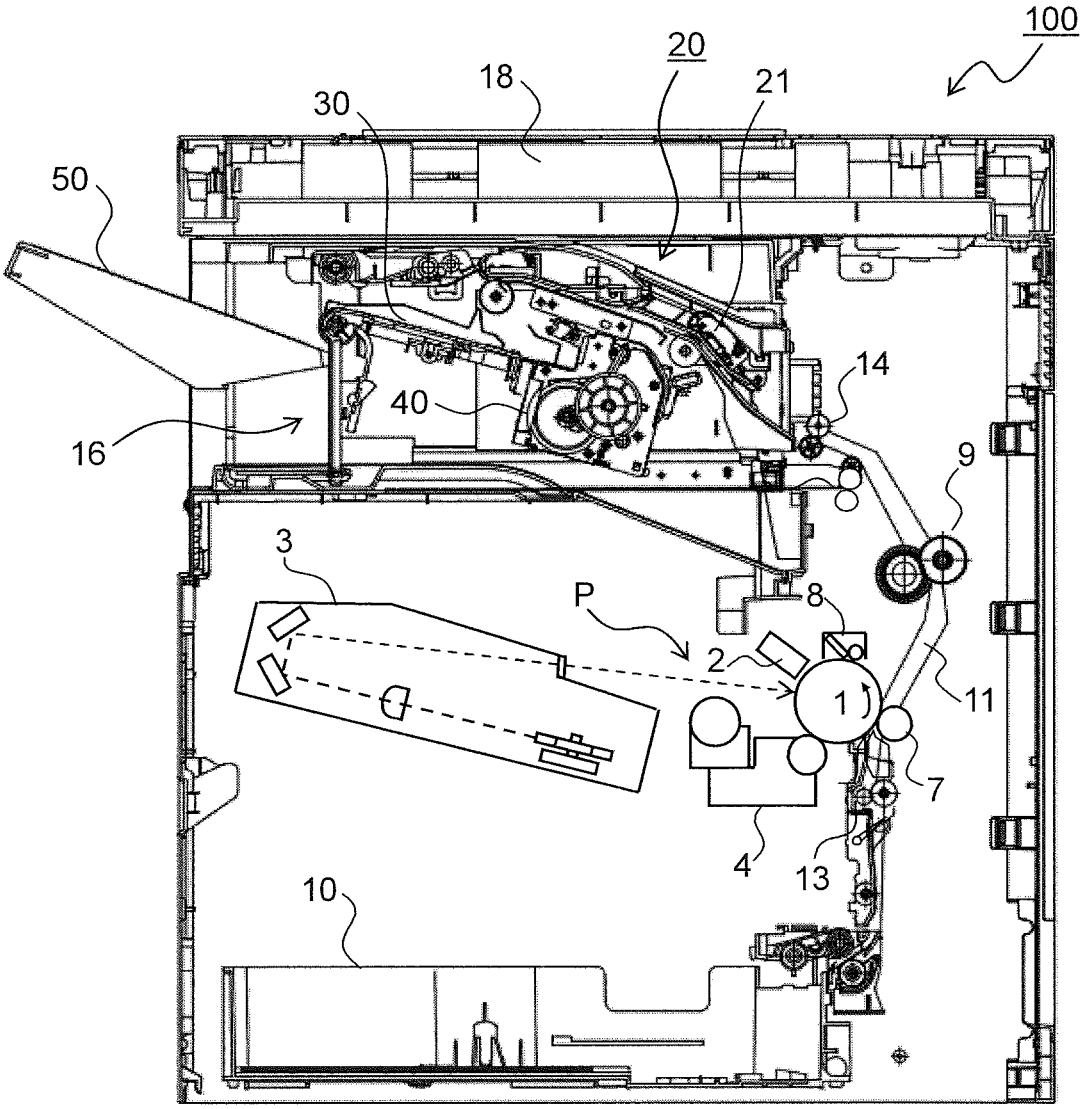
FIG. 1 is a schematic diagram showing an internal configuration of an image forming apparatus and a paper sheet post-processor provided with a sheet loading device of the present disclosure.

With reference to the appended drawings, the following describes an embodiment of the present disclosure. First, with reference to FIG. 1, a description is given of an image forming system composed of an image forming apparatus 100 and a paper sheet post-processor 20 provided with a sheet loading device 60 of the present disclosure. FIG. 1 is a schematic diagram showing an internal configuration of the image forming apparatus 100 and the paper sheet post-processor 20 of the present disclosure. While this embodiment illustratively describes a digital multi-functional peripheral as one example of the image forming apparatus 100, the paper sheet post-processor 20 of the present disclosure can be similarly connected also to apparatuses of other types than a digital multi-functional peripheral, such as, for example, a laser printer, an ink-jet printer, and a facsimile apparatus.

As shown in FIG. 1, in a main body of the image forming apparatus (for example, a monochrome multi-functional peripheral) 100, an image forming portion P is arranged that forms a monochrome image by following steps of charging, exposure, development, and transfer.

In the image forming portion P, along a rotation direction of a photosensitive drum 1 (a counterclockwise direction in FIG. 1), a charging portion 2, an exposure unit 3, a developing device 4, a transfer roller 7, a cleaning device 8, and a static eliminating device (not shown) are arranged. In the image forming portion P, an image forming process with respect to the photosensitive drum 1 is executed while making the photosensitive drum 1 rotate in the counterclockwise direction in FIG. 1.

In performing a copy operation, in an image reading portion 18, image data of an original document is converted into a read image signal. Meanwhile, in the image forming portion P, the photosensitive drum 1 rotating in the counterclockwise direction in the figure is uniformly charged by the charging portion 2. Next, based on the original document image data read by the image reading portion 18, the exposure unit 3 applies a laser beam (a light beam) on the photosensitive drum 1, and thus an electrostatic latent image based on the image data is formed on a surface of the photosensitive drum 1. After that, the developing device 4 causes toner to adhere to the electrostatic latent image, thus forming a toner image.

Toward the image forming portion P in which the toner image has been formed as described above, at prescribed timing, a paper sheet is conveyed from a paper sheet housing portion 10 via a paper sheet conveyance path 11 and a registration roller pair 13, and in the image forming portion P, the toner image on the surface of the photosensitive drum 1 is transferred on the paper sheet by the transfer roller 7. Then, the paper sheet on which the toner image has been transferred is separated from the photosensitive drum 1 and conveyed to a fixing portion 9 where the paper sheet is heated and pressed, and thus the toner image is fixed on the paper sheet.

The paper sheet that has passed through the fixing portion 9 is ejected in an intra-body paper ejection space 16 via the paper sheet conveyance path 11 and an ejection roller pair 14. The paper sheet ejected by the ejection roller pair 14 is conveyed into the paper sheet post-processor 20 that is mounted in the intra-body paper ejection space 16.

Figure 2:
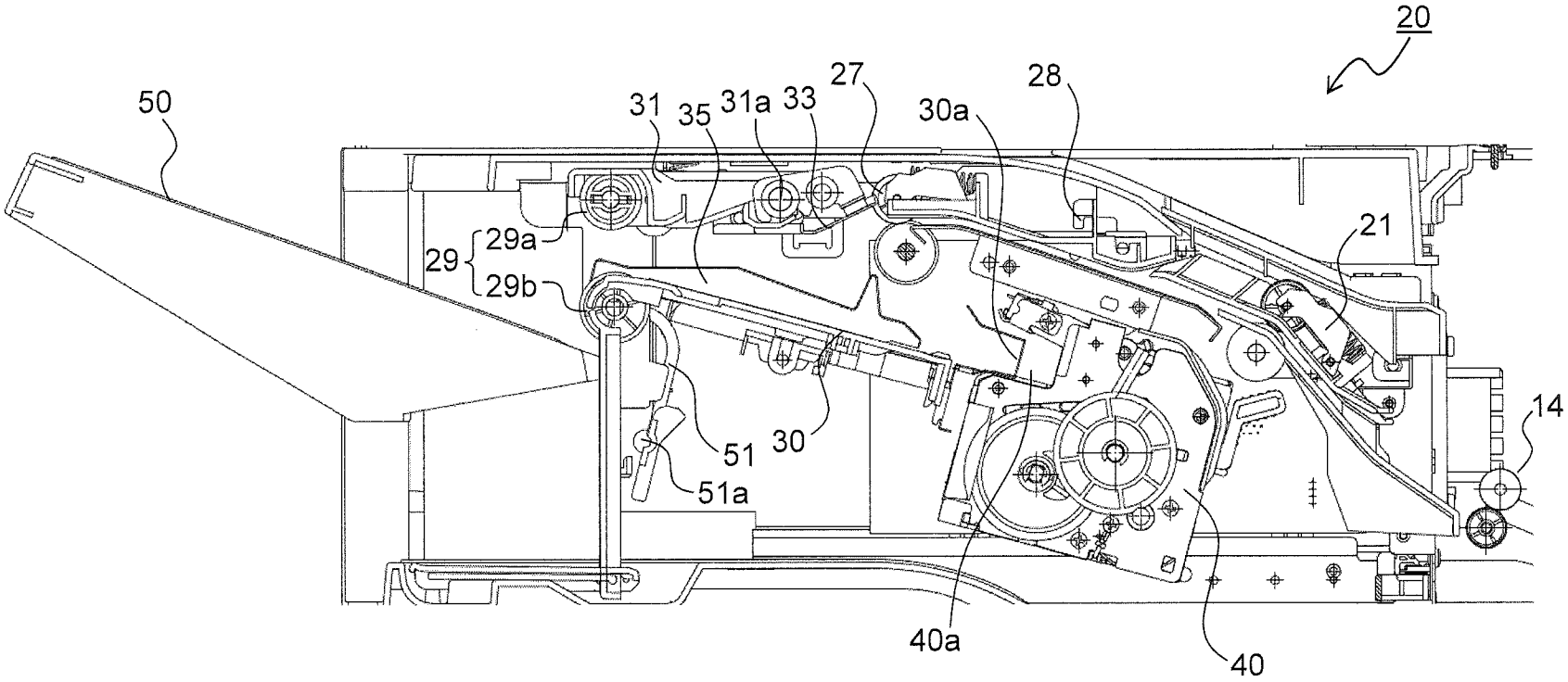
FIG. 2 is a partially enlarged view of the paper sheet post-processor in FIG. 1.

FIG. 2 is a side sectional view of the paper sheet post-processor 20. Inside the paper sheet post-processor 20, there are provided a punch hole forming device 21 that performs punch hole formation with respect to a paper sheet conveyed thereto, a processing tray 30 that loads (stacks) thereon a plurality of paper sheets conveyed thereto, and a stapler 40 that binds, with a staple(s), a bundle of paper sheets loaded on the processing tray 30. On a side surface of the paper sheet post-processor 20, an ejection tray 50 is provided that is capable of ascending/descending to a position suitable for paper sheet ejection.

The punch hole forming device 21 is disposed at an upper part in the paper sheet post-processor 20 and forms a plurality of punch holes through a paper sheet along one of side end edges thereof (a forward side or a rearward side of the apparatus) parallel to a paper sheet conveyance direction. On an upstream side of the punch hole forming device 21 and at a substantially middle part in a direction orthogonal to the paper sheet conveyance direction (a direction perpendicular to the paper plane of FIG. 2), a carrying-in detection sensor (not shown) is disposed that detects a tip end of a paper sheet carried into the paper sheet post-processor 20 by the ejection roller pair 14.

On a downstream side of the punch hole forming device 21 with respect to the paper sheet conveyance direction, a first ejection roller pair 27 is arranged. On an upstream side of the first ejection roller pair 27, an actuator-type paper sheet detection sensor 28 is disposed that detects passing of a paper sheet.

Moreover, below the first ejection roller pair 27, there are provided a processing tray 30 that loads thereon, in an aligned state, a prescribed number of paper sheets conveyed by the first ejection roller pair 27 and the stapler 40 that performs a binding process with respect to a bundle of paper sheets (a paper sheet bundle) loaded on the processing tray 30.

With respect to the paper sheet conveyance direction, on a downstream side of the processing tray 30, a second ejection roller pair 29 is arranged that ejects, from the processing tray 30, a paper sheet bundle on the ejection tray 50. The second ejection roller pair 29 is composed of an ejection roller **29*a* that is made of rubber and is rotatable forwardly and reversely by a drive motor (not shown) and an ejection roller 29*b* that is made of resin and rotates following rotation of the ejection roller 29*a*. The ejection roller 29*a* is supported to a roller holder 31 that is swingable up and down about a pivot shaft 31*a*** as a fulcrum.

Above the processing tray 30 and on a downstream side of the first ejection roller pair 27 (a left side in FIG. 2), there is arranged an aligning member 33 for aligning a paper sheet carried in by the first ejection roller pair 27 in line with a tray surface by tapping the paper sheet in a processing tray 30 direction. The processing tray 30 is provided so as to be inclined downward toward a rear end side of a paper sheet loaded thereon (a right side in FIG. 2). The second ejection roller pair 29 rotates reversely to draw in the paper sheet from the rear end side onto the processing tray 30, and a rear end of the paper sheet comes in contact with a butting portion 30*a*. Thus, on the processing tray 30, a paper sheet bundle is loaded in a state where rear ends of paper sheets of the paper sheet bundle are aligned. Furthermore, on the processing tray 30, there is provided a pair of side end alignment cursors 35 that aligns, in a width direction (the direction perpendicular to the paper plane of FIG. 2), a paper sheet bundle loaded on the processing tray 30.

The stapler 40 is movable in the paper sheet width direction orthogonal to the conveyance direction by a movement mechanism (not shown) and, depending on how a binding process is to be performed, moves to a prescribed position along the butting portion 30*a* of the processing tray 30.

Next, a description is given of an operation of the paper sheet post-processor 20. When a paper sheet that has been subjected to an image forming process at the image forming apparatus 100 is carried in, in a case where an instruction has been given to perform punch hole formation, by the punch hole forming device 21, punch holes are formed at prescribed positions (for example, two locations along a front side end edge of the paper sheet post-processor 20) on the paper sheet conveyed thereto. In a case where no instruction has been given to perform punch hole formation, the paper sheet passes, as it is, through the punch hole forming device 21.

Then, the paper sheet is conveyed further to a downstream side by the first ejection roller pair 27. At this time, as shown in FIG. 2, the roller holder 31 has swung upward, so that the ejection roller 29*a* is disposed at a position (a separated position) away from the ejection roller 29*b*. Thus, the paper sheet conveyed by the first ejection roller pair 27 passes through a gap between the ejection roller 29*a* and the ejection roller 29*b* to protrude to the ejection tray 50.

At timing at which a rear end of the paper sheet has passed through the first ejection roller pair 27, the roller holder 31 is made to swing downward so that the ejection roller 29*a* is disposed at such a position (a contact position) as to come in contact with the ejection roller 29*b*. After that, the aligning member 33 is driven to align the paper sheet in line with the processing tray 30. In this state, the ejection roller 29*a* is made to rotate reversely (in the counterclockwise direction in FIG. 2) so that the paper sheet is drawn in along the processing tray 30, and rear ends of the paper sheets thus drawn in are aligned by the butting portion 30*a*. At this time, a middle portion of the paper sheet is in a state of being nipped between the second ejection roller pair 29, and a tip end of the paper sheet protrudes from the second ejection roller pair 29 over the ejection tray 50.

Then, upon completion of acceptance of a bundle of paper sheets, the stapler 40 is made to move to cut-out positions of the buffing portion 30*a*, and rear ends of the paper sheet bundle are inserted into a staple portion 40*a* where a binding process of the paper sheet bundle is performed. After the binding process of the paper sheet bundle has been performed at the staple portion 40*a*, the second ejection roller pair 29 is made to rotate forwardly, and thus the paper sheet bundle is conveyed upward along the processing tray 30 to be ejected on the ejection tray 50.

Furthermore, in a case where shift ejection has been set to be performed, in driving the second ejection roller pair 29 so that the paper sheet bundle is ejected to the ejection tray 50, first, the roller holder 31 is made to move to the separated position. After that, the side end alignment cursors 35 are disposed at a position (a reference position) at which the paper sheet has been accepted or a position (a shifted position) that is shifted by a prescribed amount from the reference position in a direction (the paper sheet width direction) orthogonal to an ejection direction. Then, the roller holder 31 is made to move to the contact position so that the paper sheet is ejected. Thus, bundles of paper sheets are ejected alternately to a reference ejection position on the ejection tray 50 and to a shifted ejection position thereon that is shifted by a prescribed amount from the reference ejection position in the direction (the paper sheet width direction) orthogonal to the ejection direction, so that when ejected on the ejection tray 50, the bundles of paper sheets are sorted by being loaded so as to be staggered in the paper sheet width direction.

Furthermore, below the second ejection roller pair 29, a paper sheet pressing member 51 is disposed. The paper sheet pressing member 51 is supported swingably about a fulcrum 51*a* and, as shown in FIG. 2, disposed selectively at a retraced position (that does not overlap the ejection tray 50) retracted from above the ejection tray 50 or a paper sheet pressing position at which the paper sheet pressing member 51 protrudes to a position that overlaps the ejection tray 50 so as to press an upper surface of paper sheets ejected on the ejection tray 50.

Furthermore, the paper sheet pressing member 51 is a component of an upper surface detection mechanism 55 that detects, in a state of being disposed at the paper sheet pressing position, an upper surface position of a paper sheet loaded on the ejection tray 50. The upper surface detection mechanism 55 is composed of the paper sheet pressing member 51 and an upper surface detection sensor 53 (see FIG. 3 and FIG. 4) that is disposed in a neighborhood of the paper sheet pressing member 51.

Figure 3:
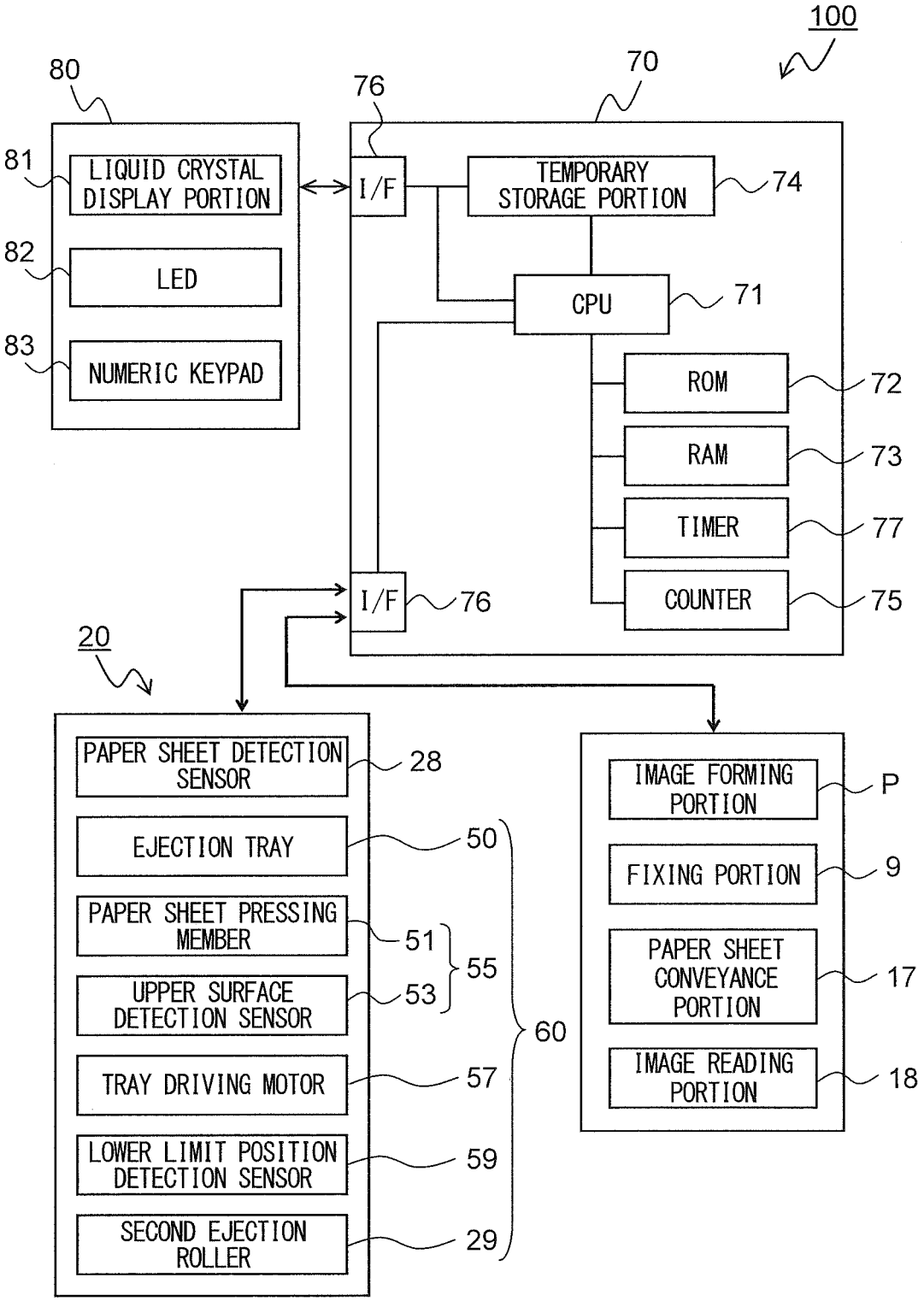
FIG. 3 is a block diagram showing a control route of an image forming system including the image forming apparatus and the paper sheet post-processor.

FIG. 3 is a block diagram showing a control route of the image forming system including the image forming apparatus 100 and the paper sheet post-processor 20. In using the image forming system, the various portions of the apparatus are controlled in different ways, rendering the control portion 70 itself structurally complicated. FIG. 3, therefore, illustrates the control portion 70 and the paper sheet post-processor 20 by focusing on portions thereof necessary to implement the present disclosure. While, herein, the entire image forming system is controlled by using the control portion 70 provided in the image forming apparatus 100, it is also possible to provide a control portion in the paper sheet post-processor 20.

Figure 4:
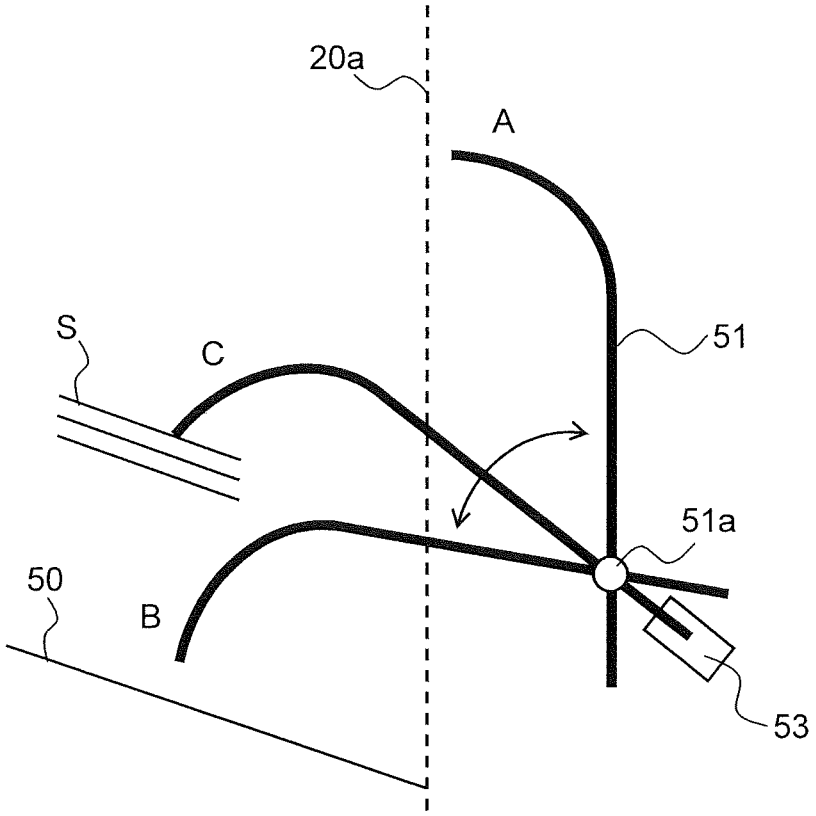
FIG. 4 is a diagram schematically showing how an upper surface position of a paper sheet loaded on an ejection tray is detected by using a paper sheet pressing member and an upper surface detection sensor.

The upper surface detection sensor 53 is a PI (photointerrupter) sensor provided with a detection portion that is composed of a light emitting portion and a light receiving portion. With reference to FIG. 4, the following describes a method for detecting an upper surface position of a paper sheet loaded on the ejection tray 50.

In a case where the paper sheet pressing member 51 is made to move from the retracted position (a position A in FIG. 4) that is retracted to an inner side (a right side in FIG. 4) of a side surface 20*a* of the paper sheet post-processor 20 to the paper sheet pressing position that lies over the ejection tray 50 in an overlapping manner, when not in contact with a paper sheet on the ejection tray 50 or an upper surface of the ejection tray 50, a tip end of the paper sheet pressing member 51 is disposed at a protruding position (a position B in FIG. 4). At this time, a light receiving signal level of the detection portion of the upper surface detection sensor 53 is in a high state. The paper sheet pressing member 51 is swingable between the retracted position and the protruding position.

As paper sheets are loaded one by one on the ejection tray 50, the paper sheet pressing member 51 is pressed by an upper surface of the paper sheets and thus swings to pivot, from the protruding position, in a clockwise direction in FIG. 4. As a result, an optical path of the detection portion of the upper surface detection sensor 53 is blocked by a light blocking plate formed in the paper sheet pressing member 51, and thus the light receiving signal level of the detection portion is switched from high to low. This position (a position C in FIG. 4) is referred to as an upper surface detection position.

A lower limit position detection sensor 59 detects whether or not the ejection tray 50 is disposed at a lower limit position. Similarly to the upper surface detection sensor 53, the lower limit position detection sensor 59 is a PI sensor. In the lower limit position detection sensor 59, an optical path of a detection portion of the lower limit position detection sensor 59 is blocked by a light blocking plate (not shown) formed in the ejection tray 50, and thus a light receiving signal level of the detection portion is switched from high to low, so that it can be detected that the ejection tray 50 is at the lower limit position.

The control portion 70 is provided at least with a CPU (central processing unit) 71 as a central arithmetic processing unit, a ROM (read-only memory) 72 that is a read-only storage portion, a RAM (random-access memory) 73 that is a readable and rewritable storage portion, a temporary storage portion 74 that temporarily stores image data and so on, a counter 75, and a plurality (herein, two) of I/Fs (interfaces) 76.

The ROM 72 contains, for example, data not to be changed such as programs for controlling the system and numerical values necessary for the control. The RAM 73 stores necessary data generated in the course of controlling the system, data that becomes temporarily necessary for the control, and so on. Furthermore, the ROM 72 (or the RAM 73) also stores a regulated sheet number setting table in which an ascending time of the ejection tray 50 and a loadable sheet number N1 that is the number of sheets loadable on the ejection tray 50 are stored in association with each other.

A timer 77 measures a driving time (an ascending time of the ejection tray 50) of a tray driving motor 57 that drives the ejection tray 50 in after-mentioned paper sheet loading control.

The counter 75 counts the number of sheets printed at the image forming apparatus 100 and also counts, based on a detection signal of the carrying-in detection sensor, the number of paper sheets carried from the image forming apparatus 100 into the paper sheet post-processor 20. Or alternatively, based on a detection signal of the paper sheet detection sensor 28 disposed on an upstream side of the processing tray 30 with respect to the paper sheet conveyance direction, the counter 75 counts the number of paper sheets carried in onto the processing tray 30. A configuration also may be adopted in which, without separately providing the counter 75, for example, the RAM 73 is set to store that number of paper sheets.

Furthermore, through the I/Fs 76, the control portion 70 transmits a control signal from the CPU 71 to each of the various portions and devices in the system including the image forming apparatus 100 and the paper sheet post-processor 20. Furthermore, through the I/Fs 76, from each of the various portions and devices, a signal indicating a state thereof and an input signal therefrom are transmitted to the CPU 71. The various portions and devices controlled by the control portion 70 include, for example, a paper sheet conveyance portion 17 including the paper sheet housing portion 10, the registration roller pair 13, the ejection roller pair 14, and so on (for each of these components, see FIG. 1), the image reading portion 18, the image forming portion P, and the fixing portion 9, which are included in the image forming apparatus 100, and the punch hole forming device 21, the first ejection roller pair 27, the second ejection roller pair 29, the processing tray 30, the stapler 40, the ejection tray 50, and the tray driving motor 57, which are included in the paper sheet post-processor 20. The second ejection roller pair 29, the ejection tray 50, the upper surface detection mechanism 55, the tray driving motor 57, and the lower limit position detection sensor 59, together with the control portion 70, constitute the sheet loading device 60 of the present disclosure.

In an operation portion 80, a liquid crystal display portion 81, an LED 82 that indicates various types of states, and a numeric keypad 83 are provided. By operating the operation portion 80, a user inputs an instruction to perform various types of settings with respect to the image forming apparatus 100 and the paper sheet post-processor 20 so that various types of functions such as an image forming function and a post-processing function are executed. The liquid crystal display portion 81 shows a state of the system, displays an image forming status and the number of sheets printed, and is used as a touch panel on which functions of double-sided printing, black/white inversion, and so on and various types of settings such as a magnification setting and a printing density setting can be performed.

Figure 5:
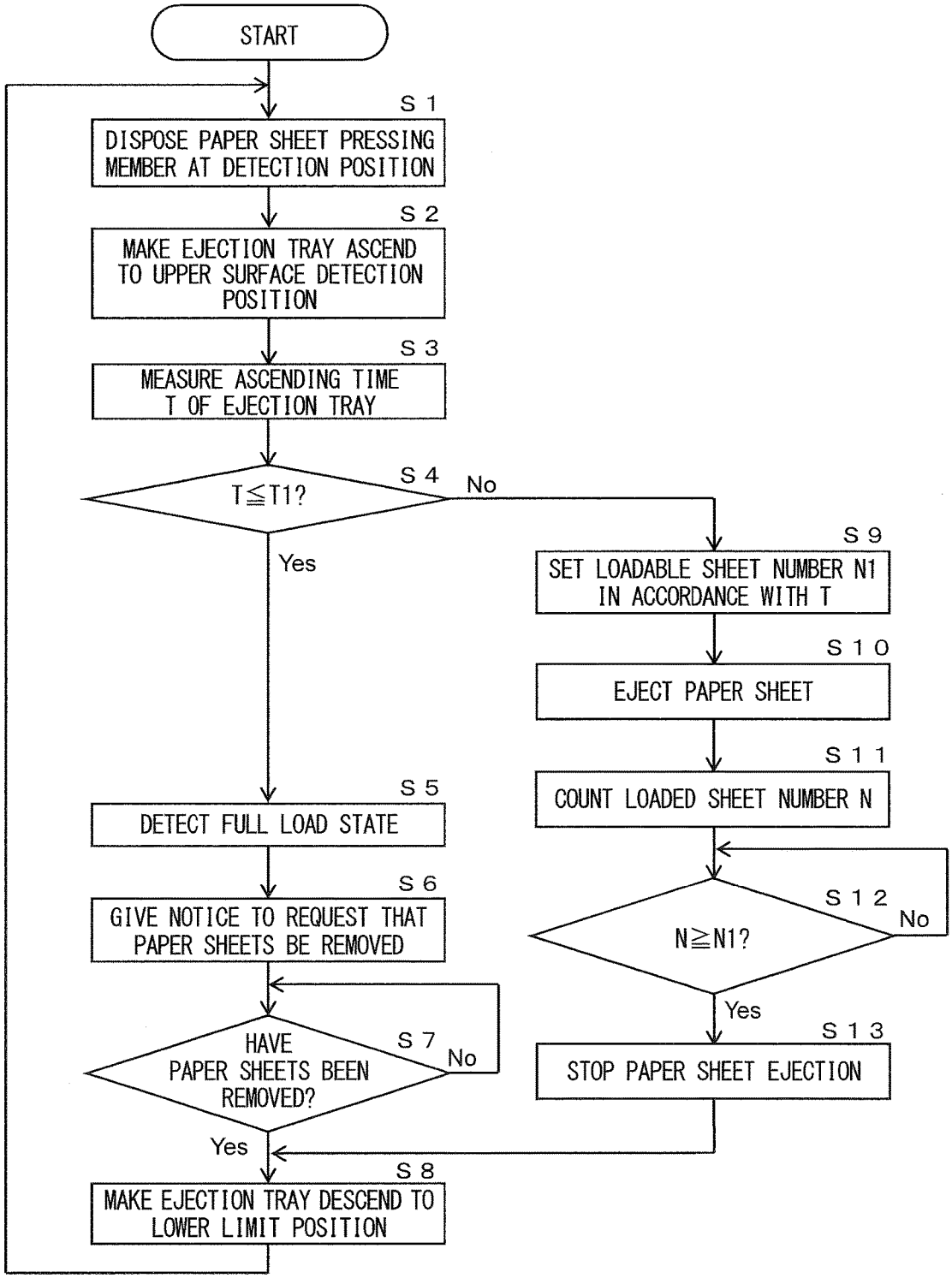
FIG. 5 is a flow chart showing one example of paper sheet loading control performed in the sheet loading device of the present disclosure.

FIG. 5 is a flow chart showing one example of paper sheet loading control performed in the sheet loading device 60 of the present disclosure. With reference to FIG. 1 to FIG. 4, by following steps shown in FIG. 5, a description is given of a paper sheet loading procedure performed in the sheet loading device 60 of the present disclosure. FIG. 5 shows paper sheet loading control in a case of loading a large-size (A3-size) paper sheet.

In the paper sheet loading control shown in FIG. 5, in a series of printing operations (one job) of performing continuous printing (continuous ejection), a loadable number of sheets of paper sheets on the ejection tray 50 is set in accordance with an ascending time of the ejection tray 50 to ascend from the lower limit position (the reference position).

Upon an input of a printing instruction by a user from the operation portion 80 (see FIG. 3) or a setting screen of a personal computer (an operation terminal), the control portion 70 starts upper surface detection by the paper sheet pressing member 51. Specifically, the control portion 70 disposes the paper sheet pressing member 51 at the detection position (the paper sheet pressing position) (Step S1). The tray driving motor 57 is driven in this state so that the ejection tray 50 ascends from the lower limit position. Then, at a point in time when the upper surface of the ejection tray 50 is detected based on a detection signal from the upper surface detection sensor 53, driving of the tray driving motor 57 is stopped. In this manner, the ejection tray 50 is made to ascend to the upper surface detection position (Step S2). Furthermore, an ascending time T of the ejection tray 50 is measured by the timer 77 (Step S3).

Next, the control portion 70 determines whether or not the ascending time T thus measured is not more than a reference time T1 (for example, 1 second) (Step S4). Then, in a case where T≤T1 (Yes at Step S4), judging that paper sheets on the ejection tray 50 are in a full load state (Step S5), the control portion 70 suspends a printing operation and gives notice to request that the paper sheets loaded on the ejection tray 50 be removed (Step S6). This notice is given by, for example, displaying a message on a liquid crystal display portion 81 of the operation portion 80.

Then, it is judged whether or not the paper sheets loaded on the ejection tray 50 have been removed (Step S7), and in a case where the paper sheets have been removed (Yes at Step S7), the ejection tray 50 is made to descend to the lower limit position (Step S8), after which a return is made to Step S1. On the other hand, in a case where the paper sheets have not been removed (No at Step S7), in a state where the ejection tray 50 is stopped from moving at the upper surface detection position, notice is continuously given to request that the paper sheets be removed.

Whether or not paper sheets loaded on the ejection tray 50 have been removed can be judged in a following manner. In a state where the paper sheet pressing member 51 has moved to the detection position, the ejection tray 50 is made to ascend, and an upper surface of paper sheets is detected based on a detection signal from the upper surface detection sensor 53. Then, the ejection tray 50 is stopped from moving at a position where the upper surface has been detected. At this time, a state is established in which the paper sheets are sandwiched between the ejection tray 50 and the paper sheet pressing member 51.

Upon removal of the paper sheets loaded on the ejection tray 50 (upon the upper surface position being lowered), the paper sheet pressing member 51 swings in a counterclockwise direction, causing a state of detection by the upper surface detection sensor 53 to be changed, and thus it can be recognized that the paper sheets loaded on the ejection tray 50 have been removed.

On the other hand, in a case where T>T1 (No at Step S4), the loadable sheet number N1 is set in accordance with the ascending time T (Step S9). As a default state, the ejection tray 50 is disposed at the lower limit position. Normally, the loadable sheet number N1 is set to a value corresponding to a length of the ascending time T required for the upper surface of the ejection tray 50 in a state where no paper sheets are loaded thereon to reach the upper surface detection position. Furthermore, in a case where any paper sheet is remaining on the ejection tray 50, the loadable sheet number N1 is set to a value corresponding to a length of the ascending time T required for an upper surface of the any paper sheet to reach the upper surface detection position. That is, the larger the number of paper sheets loaded on the ejection tray 50, the shorter the ascending time T of the ejection tray 50, and thus the loadable sheet number N1 is set to a value increasing with increasing length of the ascending time T. For example, N1=100 (sheets) is set in a case where the ascending time T has a length of more than 1 second and not more than 2 seconds, N1=200 (sheets) is set in a case where the ascending time T has a length of more than 2 seconds and not more than 3 seconds, and N1=300 (sheets) is set in a case where the ascending time T has a length of more than 3 seconds.

After that, printing is started, and thus a paper sheet is ejected on the ejection tray 50 (Step S10). At this time, during ejection of the paper sheet, the paper sheet pressing member 51 moves to the retracted position so as not to interfere with paper sheet ejection, and at a point in time when the paper sheet thus ejected is loaded on the ejection tray 50, the paper sheet pressing member 51 moves to the paper sheet pressing position. This sequence of operations is repeatedly performed every time one paper sheet is ejected. Further, based on a detection signal from the upper surface detection sensor 53, as the number of paper sheets loaded increases, the control portion 70 controls the ejection tray 50 to gradually descend from the upper surface detection position. Furthermore, a loaded sheet number (ejected sheet number) N of paper sheets loaded on the ejection tray 50 is counted by the counter 75 (Step S11).

Next, the control portion 70 judges whether or not the loaded sheet number N counted by the counter 75 has reached not less than the loadable sheet number N1 (Step S12). In a case where N<N1 (No at Step S12), paper sheet ejection is continuously performed without any change. Also when, in a state where N<N1, it is detected that paper sheets loaded on the ejection tray 50 have been removed, paper sheet ejection is continuously performed until N≥N1.

On the other hand, in a case where N≥N1 (Yes at Step S12), it is judged that the ejection tray 50 is in a full load state, and thus paper sheet ejection is stopped (Step S13). After that, an advance is made to Step S8 where the ejection tray 50 is made to descend to the lower limit position (Step S8), after which a return is made to Step S1, and a similar procedure is repeatedly performed thereafter.

Meanwhile, in a case of loading a small-size (A4-size) paper sheet on the ejection tray 50, paper sheet loading is started in a state where the ejection tray 50 has ascended to the upper surface detection position. Further, as the number of sheets loaded increases, the ejection tray 50 is made to descend. At a point in time when the lower limit position is reached, it is judged that paper sheets on the ejection tray 50 are in a full load state, based on which paper sheet ejection is stopped, and notice is given to request that the paper sheets loaded on the ejection tray 50 be removed.

By performing the above-mentioned control, the loadable sheet number N1 is set to an appropriate value in accordance with the ascending time T required for the ejection tray 50 to ascend from the lower limit position to the upper surface detection position. Thus, before an upper surface of paper sheets loaded on the ejection tray 50 ascends to such a position that the paper sheets might collide with a paper sheet being ejected by the second ejection roller pair 29, a user can be given notice to encourage paper sheet removal. Accordingly, paper sheets loaded on the ejection tray 50 are prevented from being pushed out in the ejection direction by a succeedingly ejected paper sheet, and an alignment failure of paper sheets on the ejection tray 50 and falling of a paper sheet from the ejection tray 50 can be effectively prevented.

Furthermore, when the number of paper sheets ejected has reached the loadable sheet number N1, paper sheet ejection is stopped. Further, the ejection tray 50 is made to descend once to the lower limit position and then to ascend again to the upper surface detection position, and the loadable sheet number N1 is reset in accordance with the ascending time T. Thus, for example, even in a case where a user has removed some or all of paper sheets loaded on the ejection tray 50, a value of the loadable sheet number N1 is determined correspondingly to the number of paper sheets thus removed. Accordingly, regardless of a loading amount of paper sheets on the ejection tray 50, it becomes possible to set the loadable sheet number N1 to an appropriate value, and thus a paper sheet loading amount on the ejection tray 50 can be appropriately managed. Moreover, even in a case where paper sheets are removed before the number of paper sheets ejected reaches the loadable sheet number N1, paper sheet ejection is continuously performed until the loadable sheet number N1 is reached, so that paper sheet ejection is prevented from being stopped when unnecessary.

Other than the above, the present disclosure is not limited to the above-described embodiment, and various modifications thereto are possible without departing from the spirit of the present disclosure. For example, while the above-described embodiment has described, as an example, the sheet loading device 60 that loads thereon a paper sheet ejected from the paper sheet post-processor 20 connected to the image forming apparatus 100, the present disclosure is applicable also in a sheet loading device that loads thereon a paper sheet ejected from the image forming apparatus 100.

Furthermore, while in the above-described embodiment, paper sheet loading control based on an ascending time of the ejection tray 50 is applied only to a large-size paper sheet (A3-size), the paper sheet loading control is applicable similarly also to a small-size paper sheet (A4-size). In this case, the loadable sheet number N1 set based on the ascending time T is set to be larger than in a case of a large-size paper sheet, and thus appropriate paper sheet loading control corresponding to a paper sheet size can be performed. Furthermore, when the loadable sheet number N1 is changed in accordance with, other than a paper sheet size, a thickness or a weight per unit area (a basis weight) of a paper sheet, a printing rate of an image to be printed, or the like, appropriate paper sheet loading control corresponding to a type of a paper sheet or a printing rate can be performed.

The present disclosure is usable in a sheet loading device that loads thereon a sheet ejected from a sheet ejection portion. By use of the present disclosure, there can be provided a sheet loading device in which, in a case of loading a plurality of types of sheets thereon, without the need to provide a plurality of load detection sensors, a full load state of a sheet loading portion can be reliably detected, a sheet post-processor and an image forming apparatus provided with the same.

What is claimed is:

1. A sheet loading device, comprising:

a sheet ejection portion that elects a sheet;

a sheet loading portion that is capable of ascending or descending and on which the sheet ejected from the sheet ejection portion is loaded;

a first detection mechanism that detects an upper surface of the sheet loading portion or of the sheet loaded on the sheet loading portion;

a driving device that drives the sheet loading portion to ascend or descend between an upper surface detection position at which the upper surface of the sheet loading portion or of the sheet loaded on the sheet loading portion is detected by the first detection mechanism and a reference position made to descend by a prescribed distance from the upper surface detection position;

a second detection mechanism that detects that the sheet loading portion is at the reference position;

a control portion that controls sheet ejection from the sheet ejection portion and ascending or descending of the sheet loading portion by the driving device;

an accepter that accepts input for a type of the sheet ejected from the sheet ejection portion; and a timer that measures an ascending time of the sheet loading portion, wherein in a case where sheets of a same type are ejected continuously from the sheet ejection portion, the control portion controls, before the sheets are ejected from the sheet ejection portion, the sheet loading portion to ascend from the reference position to the upper surface detection position, and determines a loadable number of the sheets on the sheet loading portion in accordance with the ascending time of the sheet loading portion, when a number of the sheets loaded on the sheet loading portion has reached the loadable number of sheets, the control portion controls the sheet loading portion to descend to the reference position and then to ascend to the upper surface detection position, and when the ascending time of the sheet loading portion has a length not more than a prescribed length of time, the control portion stops the sheet ejection from the sheet ejection portion.

2. The sheet loading device according to claim 1, wherein when the ascending time of the sheet loading portion has a length longer than the predetermined length of time, the control portion resets the loadable number of sheets in accordance with the ascending time of the sheet loading portion.

3. The sheet loading device according to claim 1, wherein when the ascending time of the sheet loading portion has a length not more than the predetermined length of time, the control portion gives notice to encourage removal of paper the sheets loaded on the sheet loading portion.

4. The sheet loading device according to claim 1, wherein in a case where, after the sheet ejection from the sheet ejection portion is stopped, lowering of a sheet upper surface position is detected by the first detection mechanism, the control portion controls the sheet loading portion to descend to the reference position and then to ascend to the upper surface detection position, and resets the loadable number of sheets in accordance with the ascending time of the sheet loading portion.

5. The sheet loading device according to claim 1, wherein in a case where, before the number of the sheets loaded on the sheet loading portion reaches the loadable number of sheets, lowering of a sheet upper surface position is detected by the first detection mechanism, the control portion continuously performs the sheet ejection from the sheet ejection portion until the number of sheets loaded on the sheet loading portion reaches the loadable number of sheets.

6. A sheet post-processor comprising the sheet loading device according to claim 1.

7. An image forming apparatus comprising the sheet loading device according to claim 1.

* * * * *